United States Patent [19]

Reynolds

[11] 4,291,864

[45] Sep. 29, 1981

[54] DRUM WINCHES

[76] Inventor: Darcie F. Reynolds, 5 Duke St., Forestville, New South Wales 2087, Australia

[21] Appl. No.: 60,005

[22] Filed: Jul. 24, 1979

[30] Foreign Application Priority Data

Jul. 26, 1978 [AU] Australia ..... PD5237

[51] Int. Cl.[3] ..... B66D 1/30

[52] U.S. Cl. ..... 254/375; 64/30 E; 192/45; 192/56 R; 254/380

[58] Field of Search ..... 254/355, 356, 375, 370, 254/262, 380; 242/106; 64/30 E; 192/45, 56 R

[56] References Cited

U.S. PATENT DOCUMENTS

| | | | |
|---|---|---|---|
| 3,642,253 | 2/1972 | Baldwin et al. | 254/375 |
| 3,712,431 | 1/1973 | Versoy | 254/375 X |
| 3,809,368 | 5/1974 | Lawrence | 254/370 X |
| 3,818,722 | 6/1974 | Vogel | 64/30 E |

*Primary Examiner*—Philip R. Coe

[57] ABSTRACT

A drum winch for a yacht has a drum rotatably mounted on a supporting shaft structure through roller clutch means to permit rotation of the drum in one rotary direction only and seal means are provided for sealing the roller clutch means from the exterior of the winch, the seal means preferably being of a stretched O-ring arrangement mounted over an annular ramp-like surface having a radially inwardly directed component. The roller clutch means is dimensioned relative to the exterior diameter of the shaft structure and/or relative to the internal diameter of a central bore in the drum so that a yieldable interference fit is established with lubricant whereby if the load applied to the drum exceeds a predetermined load which is less than the load which would cause damage or destruction of the roller clutch means, creep or slippage occurs at the yieldable interference fit. A novel profile for the drum is also provided and a bayonet-like mounting plate arrangement to permit quick mounting and dismounting the drum winch is also disclosed.

15 Claims, 6 Drawing Figures

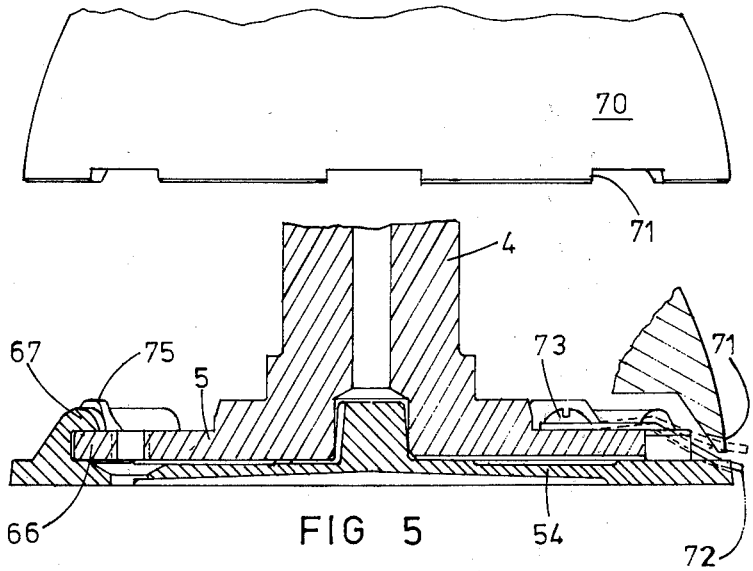
FIG 5
FIG 6
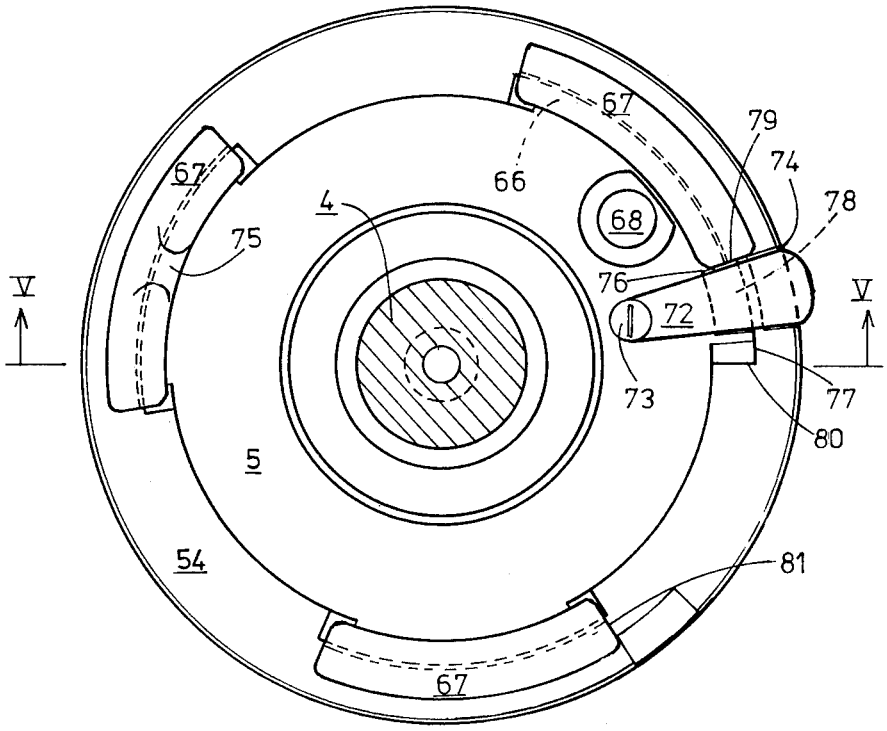

DRUM WINCHES

FIELD OF THE INVENTION

The present invention relates to a winch for use on a yacht or for similar purposes and which is suitable for pulling a rope, wire, sheet or other elongated flexible member. In this specification the expression "line" is used to cover any form of elongated flexible member.

The winches to which the present invention relates have a drum around which the line is wound, the tail of the line being suitably held so that when the line is under tension the strain is taken by the drum with frictional forces occurring between the drum and the line.

It is to be understood the present invention, although particularly applicable to winches for yachts, extends to winches which may equally be suitable for other purposes such as mounting on vehicles. Furthermore the invention equally applies to winches which are adapted to be driven either manually or by a suitable motor powered drive system or to winches which essentially have a holding function only, such winches being known as snubbing winches when applied to yachts.

BACKGROUND OF THE INVENTION

Hitherto, winches for yachts in general have relied on latching engagement established through a pawl and latch type system associated with a gear train, the components being packed in suitable lubricant for protection against corrosion. However, salt water has the potential for causing electrolytic, abrasive and corrosive effects on the winch components thereby resulting in the necessity for relatively frequent servicing, cleaning and lubricating and malfunctioning of winches is a common problem. It is considered there has been a long standing need for improved winches which can offer higher reliability and are capable of manufacture at relatively low cost.

SUMMARY OF THE INVENTION

According to a first aspect of the present invention there is provided a winch for a yacht comprising:

(a) a supporting shaft structure, (b) roller clutch means mounted on the shaft structure, (c) a drum mounted over the roller clutch means and rotatable thereon in a first direction about the shaft structure but restrained by the clutch means against rotation in the opposite rotary direction, (d) seal means for sealing the roller clutch means from the exterior of the winch, and (e) the roller clutch means being dimensioned to have a yieldable interference fit assembly with lubricant such that if the load applied to the drum in said opposite rotary direction exceeds a predetermined value creepage at the interference fit will occur, said predetermined value being less than that which would damage the roller clutch means.

At least preferred embodiments of such a winch can be manufactured economically using known roller clutch units which, because they are manufactured in very high volume and with high precision can be relatively cheap. However the materials necessary for satisfactory manufacture of roller clutch units are not corrosion resistant being of hardened steel. The present invention permits effective use of such roller clutch units by virtue of the provision of effective sealing arrangements and permitting slippage or creep to protect the clutch unit against damage in the event of shock or overload conditions. Assembly of the clutch units in the winch in an interference fitting manner with a lubricant has been found, surprisingly, to provide for the effective use of roller clutch units. At least preferred embodiments of the invention should be maintenance free and have a long working life. Furthermore the winch can be essentially devoid of backlash and silent in operation a considerable advantage to racing yachts.

Preferably the roller clutch means has a hardened steel sleeve as an inner member over which its rollers run and an outer hardened steel case member; the necessary interference fit with the ability for slippage or creep to occur can be provided at either or both of the engagements between the sleeve and the shaft structure or case member and drum.

An suitable long-life assembly lubricant can be used such as molybdenum disulphide.

The preferred form of seal means is one using a resilient O-ring preferably used at each point for which sealing is required, the O-ring being stretched slightly and by virtue of its inherent resilience arranged to tend to contract onto the parts of the winch to be sealed. These parts are inclined towards one another and at least one of the surfaces in engagement with the O-ring has an annular ramp-like surface being radially inwardly inclined. This arrangement can have the major advantage of normally functioning under negative internal pressure within the winch tending to enhance the sealing pressure. This arises because air and/or lubricant within the winch on assembly is forced out past the seal when the winch subsequently is heated and because of the sealing power of the O-ring, at any lower temperature a negative pressure may be established within the winch. Furthermore, as wear occurs at the seal, there is a continuous tendency for the seal to move up the ramp-like surface to seal on fresh lubricated seat area.

The present invention can be applied not only to snubbing winches, the drum of which is not to be driven, but also to driven winches including those having a bottom or top handle and indeed an embodiment of the invention can consist in a winch adapted to receive both a top and bottom handle.

When the invention is applied to a winch which is adapted to be driven, a drive member is rotatably mounted for rotation about the axis of the shaft structure by the handle and second roller clutch means are utilised for transmitting torque to the drum in a first direction only and permitting return motion of the handle in the opposite direction.

According to a second aspect of the invention there is provided a drum for a winch suitable for use on a yacht, the drum comprising an upper end portion with a radially outwardly extending lip, an intermediate reduced diameter portion which tapers in diameter progressively towards the lower end portion of the drum and the lower end portion of the drum has a concave profile with the bottom shoulder projecting radially outwardly.

Most preferably the drum profile is such that the intermediate reduced diameter portion is a straight taper of about 5° and at the lower end portion the outwardly curved profile has a radius of curvature approximately equal to the radius of the drum in the middle of its intermediate portion. This arrangement can be very beneficial in providing effective engagement and handling of a line such as a sheet on a yacht.

One conventional form of drum for a winch has an arcuate central portion for accommodating the turns, the uppermost turn leading to the free tail of the sheet. This arrangement is considered disadvantageous in that the turns carrying the highest load tend to move to the smallest diameter portion of the drum and there is a rolling tendency of the turns as the sheet is pulled in. Another conventional form of drum is one which is essentially a parallel sided drum with a substantial outwardly extending lip at the upper end, this lip rendering its difficult to throw off the tail of the sheet. In this design there is no interaction in substance between adjacent turns and the winch relies on friction between the sheet and drum face necessitating a roughened, high friction surface. This can cause rapid wear of sheets due to abrasion.

The second aspect of the invention provides for a useful alternative in which a relatively small lip may be provided at the top of the winch to allow a fast throw off of the tail of the sheet yet a large number of turns can still be applied to the drum. Especially when a taper of about $4\frac{1}{2}°$ is utilised, the centre of each successive turn of sheet around the drum should essentially lie in a direct line extending up the drum thereby resulting in compression between adjacent turns so that frictional holding forces arise partially by virtue of engagement between adjacent turns of sheet and partially between the turns and the drum surface. Furthermore the provision of a relatively deep concave bottom portion on the drum can facilitate feeding in of the sheet to the drum and this feature can help prevent any tendency for the turns to override one another. A further important advantage that can be achieved with this drum shape contrasted to a parallel sided drum is that on partial release of the tail of the sheet in order to pay out a relatively small amount of sheet, for example when freeing-off a sail, good control can be obtained due to progressive reduction in frictional forces.

According to a third aspect of the invention there is provided a drum winch for a yacht in which a drum is rotatably mounted on a shaft structure having a flanged base and the winch includes a mounting plate adapted to be secured to the yacht and having a plurality of undercut retaining lugs spaced around the axis of the shaft, the flanged base having corresponding peripherally extending projections adapted to be engaged in a bayonet-like manner with the lugs and the arrangement being such that the lugs and projections are asymmetric whereby the winch can be mounted in one rotary position only.

Advantageously any two or more of the above described aspects of the invention may be utilised in combination and further advantageous features will be described hereinafter with reference to specific embodiments of the invention which are given for illustrative purposes only.

BRIEF DESCRIPTION OF THE DRAWINGS

Embodiments of the invention will be described with reference to the accompanying drawings, of which:

FIG. 5 is a partially sectioned, partially exploded view of a drum winch which may be in accordance with the embodiment of FIGS. 3 and 4 showing details of a mounting plate arrangement; and FIG. 6 is a plan view of the mounting plate arrangement of FIG. 5.

DETAILED DESCRIPTION OF THE DRAWINGS

Figure 1:
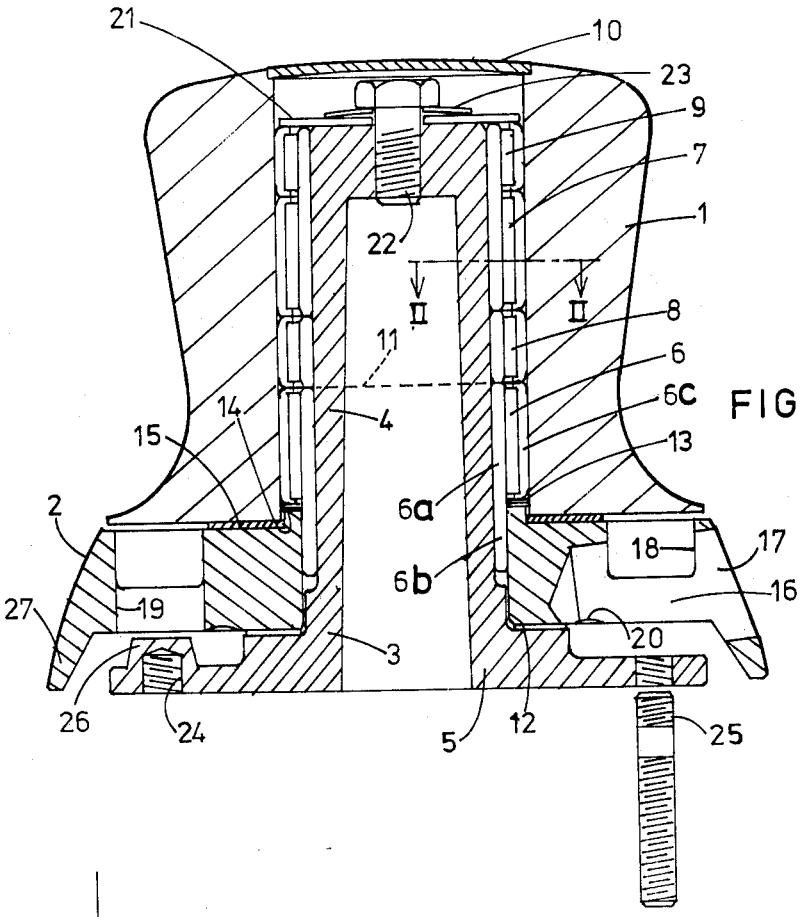
FIG. 1 is a cross-sectional elevation through a yacht winch of a bottom loading type.

Referring first to FIG. 1, the winch comprises a drum 1, a drive plate 2, a mounting shaft structure 3 having a shaft 4 and integral base portion 5, first and second roller clutch units 6 and 7 and first and second roller bearing units 8 and 9.

The drum is formed with a parallel sided central bore within which the outer sleeve-like members of both clutch units and roller bearing units are interference fits. A cavity defined between the drive plate 2, mounting shaft structure 3 and drum 1 accommodates the roller clutch units and roller bearing units and is provided with a quantity of suitable lubricant, the cavity being sealed by a sealing cap 10.

The shaft 4 is also parallel sided but has a very shallow step 11 as indicated by dotted lines, the lower portion of the shaft 4 being of smaller exterior diameter so that an inner hardened steel sleeve **6*a*** of the first clutch unit is a clearance fit over the shaft.

The drive plate 2 is of annular form having an interior bore within which a downwardly projecting end portion **6*b* of the inner sleeve 6*a*** of the first clutch unit is an interference fit and this interference fit is reinforced, for example by using a locking fluid so that torque is transmitted.

The drive plate 2 is rotatable relative to both the drum 1 and the mounting shaft 3, P.T.F.E. washers 13 and 14 being provided as a self-lubricating vertical thrust bearings. Although the large washer 12 provides some sealing function, the main seal at the bottom of the shaft is established by packing with lubricant the narrow gap between the exterior of the shaft and the interior bore of the drive plate 2. Immediately beneath an outer sleeve member **6*c* of the first clutch unit and the washer 13 is a small sealing washer 14 conveniently of felt impregnated with water repellent material. A further sealing washer 15 is provided in the gap between the bottom of the drum and the upper surface of the drive plate 2**, this also being of felt impregnated with water repellent.

At one side, the drive plate 2 has a generally radially directed cavity 16 for receiving the end of a drive handle, the axis of the cavity being slightly inclined to the general plane of the drive plate; this cavity has a circular shaped opening 17 for receiving the end of a handle. An annular groove 18 extends from the top of the drive plate 2, this groove intersecting with the cavity 16 for receiving the handle. The end of the handle has spring tangs which can expand into the open top and bottom portions of the cavity for retaining the handle.

A downwardly directed bore 19 also intersects with the groove 18 on the opposite side of the drive plate. The bore 19 acts to drain the annular groove. Furthermore, the illustrated drive plate may be used in other embodiments of the invention in which the base 3 is adapted to be secured in position by bolts or screws inserted, when a cut-out in the drum bottom portion (not shown) is aligned with cavity 19.

On its underside and adjacent the first step in the base portion 5, a shallow annular groove 20 is provided to act as a drip edge for deflecting any water away from the seal 12.

When the winch is assembled and before fixing of the sealing cap 10, a retaining washer 21 is secured in position by a fixing bolt 22 having its associated spring washer 23; this arrangement ensures the maintenance of a preload on the sealing elements and thrust washers.

The base portion 5 includes a series of tapped bores 24 spaced uniformly for the purpose of receiving fixing screws 25 which are intended to be inserted beneath the structure to which the winch is to be attached.

The base portion 5 also includes an upwardly projecting stop 26 which extends into an annular cavity defined between the first shoulder in the base and a downwardly depending skirt 27 on the exterior of the drive plate 2. When the end of a handle is inserted in the cavity 16, the bottom portion of the handle will engage the stop 26 at a limit position thereby preventing any further rotation of the handle.

The exterior profile of the drive plate 2 is intended to complement the shape of the drum and to lead the line or sheet onto the drum.

Figure 2:
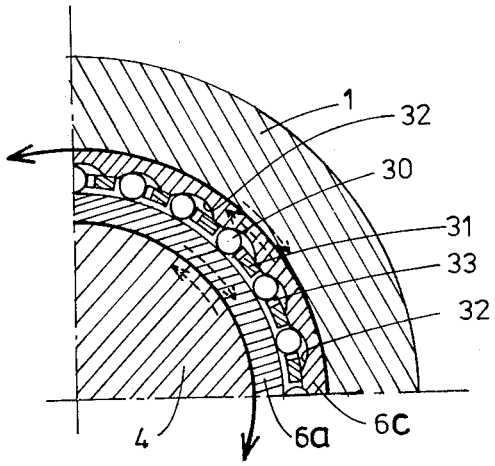
FIG. 2 is a transverse sectional view on an enlarged scale illustrating a roller clutch unit taken along the line II—II of FIG. 1.

FIG. 2 shows the particulars of the clutch 7 which is the same as clutch 6 but functions as a back-stop clutch. The clutch 7 includes a series of hardened steel rollers 30, a retaining cage structure 31, a hardened steel outer member **6*c* and a hardened steel inner sleeve member 6*a*. The outer case member 6*c* has arcuate shaped cavities 32 such that if for example the outer member 6*c* is displaced relatively in an anti-clockwise direction the arcuate cavities are displaced so that their deeper portions align with the rollers 30 whereby no torque is transmitted to the inner sleeve member 6*b*, the rollers simply being urged in an anti-clockwise direction by leaf-type springs 33 against respective end faces of the cage member 31. If the outer cage member 6*c* is urged in a clockwise direction then the arrangement substantially as shown in the drawing occurs with a wedging action occurring between the rollers 30 and end portions of the arcuate recesses 32 whereby torque is transmitted to the inner steel sleeve 6*a***.

As described above, an interference but lubricated fit is established between the drum 1 and the outer case member **6*c* and also preferably a similar fit is established between the hardened steel sleeve inner member 6*a* and the shaft 4 whereby creep can occur if an overload condition arises. In a yacht winch the amount of creep would ordinarily be limited so that continous slippage will not occur and there should not be a wear problem or a heating problem. In the case of a winch of the type shown in FIG. 1, if the clutch unit 7 undergoes such creep the other clutch unit 6 will act as a back-up to absorb load when the handle inserted in the bottom drive member 2** reaches an end position. Furthermore when a line has its free tail attached to a cleat, any creepage at the clutch unit will be arrested when the degree of excess load is taken up by the cleat.

Figure 3:
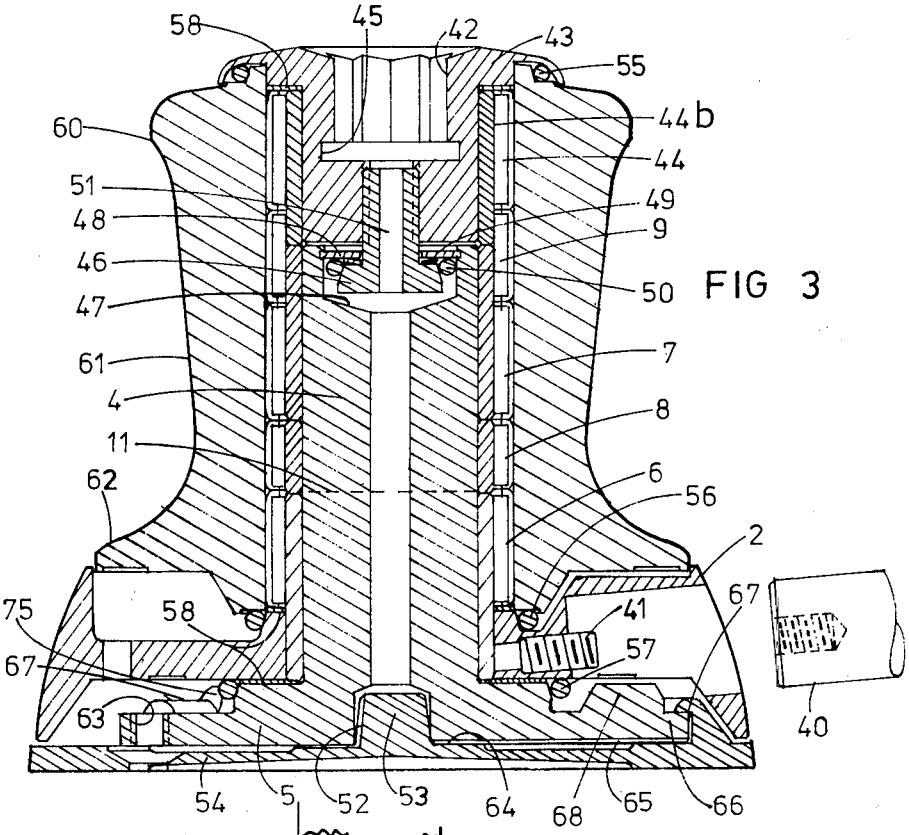
FIG. 3 is a sectional elevation of a second embodiment of drum winch having both top and bottom loading facility.
Figure 4:
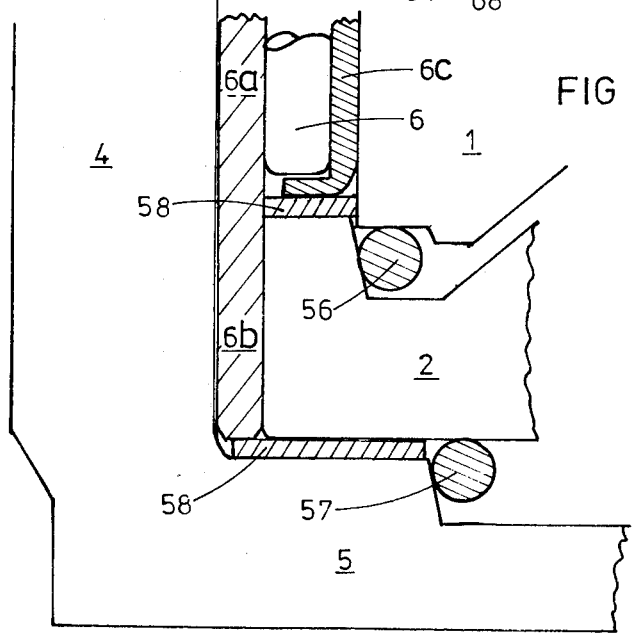
FIG. 4 is a detailed view on an enlarged scale illustrating the sealing arrangement in the drum winch of FIG. 3.

Referring now to FIG. 3, the winch illustrated is similar to the winch of FIG. 1 and like parts have been given like reference numerals and only the distinctions will be described in detail. In this embodiment provision is made for use of the winch in either a top loading or bottom loading manner. In this case the bottom loading handle 40 is adapted to be screw fitted onto a receiving stud 41 within the drive plate 2 the receiving stud being fixed by locking fluid against rotation. For use in a top loading manner with a cranked drive handle a conventionally dimensioned drive socket 42 is provided in a top cap 43 and for transmitting load a third drive clutch 44 is mounted above the roller bearing 9 and in this case the roller bearing 9 is of longer form so as to overlap and engage an inner hardened steel sleeve member **44*b* of the third clutch 44**.

The socket 42 also is provided with an undercut recess 45 so that a locking element of a conventional crank handle can be engaged to secure the crank handle in position if desired.

It will be noted that the top cap has a cylindrical side wall extending downwardly from the outwardly extending top flange, the cylindrical wall being a sliding fit in the top part of the central bore in the drum 1 whereby any force having a radial component relative to the axis of the winch is absorbed by this bearing arrangement thereby protecting the third drive clutch 44 from damage.

The top cap is assembled and retained in position by screw threaded engagement with a captive mounting screw 46 temporarily held against rotation by a left hand, threaded, tapered mandrel (not shown) during assembly. The screw 46 is retained in a top recess 47 in the shaft 5 by virtue of a captive washer 48 secured by peining over the top of the shaft 5. A spring washer 49 is provided under the washer 48 and an O-ring seal 50 seals the interior of the winch. The screw-threaded engagement of the top cap 43 with the screw 46 is reinforced with locking fluid.

It will be noted that a drain tube is established for draining any water from the socket 42, the drain tube 51 extending down through the screw 46 and the shaft 5, water flowing away through a drainage relief 52 provided in the boss 53 of a mounting plate 54.

The O-ring seal 50 and the further O-ring seals 55, 56 and 57 are similarly installed by being slightly stretched against their inherent resilience and each being mounted over an inclined surface which tapers radially inwardly so that the seal tends to ride over the inclined surface into sealing engagement between the parts to be sealed. The O-ring is assembled using a suitable lubricant such as silicon grease, the O-ring being from a suitable material such as nitrile rubber.

For the purpose of taking the small degree of end thrust, PTFE washers 58 are provided where indicated.

The profile of the drum 1 comprises an upper lip 60 having a slight shoulder for the purpose of retaining the sheet but permitting easy and rapid throw off of the top turn around the drum, a reduced diameter central portion 61 which has a straight taper of $4\frac{1}{2}°$ in the downward direction and a lower shoulder 62 which in this embodiment has a radius of curvature of about $\frac{3}{4}''$ which is approximately half the radius of the central portion 61. The shape of the shoulder 62 facilitates leading in of the sheet, and the taper on the central portion can permit effective functioning of the winch, in particular by permitting the load to be absorbed by frictional engagement not only between the turns of the sheet and the surface of the drum but also between adjacent turns of the sheet.

It will be furthermore noticed that the profile of the drive member 2 is smoothly curved to facilitate a leading in of the sheet around the drum. When the sheet is slack, and a bottom handle 40 is inserted, because the handle 40 will ordinarily be outboard of the winch when the winch is used for sheets on a yacht, the handle itself can act to guide the sheet to the correct location for take up on the drum.

The flanged base 5 is provided with a series of circumferentially spaced tapped bores 64 for co-operation with fixing screws if the winch is to be used with a permanent mounting without the use of the mounting plate 54.

The mounting plate 54 permits quick fitting and removal of a winch when desired in a generally bayonet-like manner. The mounting plate has an annular load supporting zone 64 around the central boss 53, this zone being slightly higher than the outer areas 65 on the top of the mounting plate whereby on assembly a series of circumferentially spaced engagement projections 66 on the flanged base 5 are urged upwardly under corresponding undercut retention lugs 67 on the mounting plate. The configuration of the projections 66 and lugs 67 is generally as shown in FIGS. 5 and 6.

An internal stop 68 is provided at one position projecting upwardly from the top of the base 5, the stop being also exemplified in FIG. 6. The object of the stop is to limit rotation of the handle 40 in normal use and to facilitate installation and removal of the drum winch. To remove the drum winch, the handle is removed and the drive plate 2 rotated by hand past the normal limit position and the handle re-inserted. Rotation is continued until the handle comes against the opposite side of the stop and thereby causes the flanged base 5 to rotate to release projections 66 from the retention lugs 67 so that the winch may be lifted off.

A limit stop which is shown in the embodiment of FIG. 6 is also included to limit rotary motion in both directions to ensure easy engagement and disengagement of the flanged base on the mounting plate.

Referring now to FIGS. 5 and 6, a further optional feature to be associated with the mounting arrangement is provided this being particularly important where only a top loading winch is provided although the features described can also be used in the embodiment of FIG. 3.

As shown in FIG. 5 a skirt portion 70 has spaced radially extending slots 71 around its periphery on the lower side. This skirt 70 is either the profile of the drive member 2 shown in FIG. 3 or alternatively an extension skirt integrally formed with the drum 1. The flanged base 5 carries a spring tag 72 fixed by a screw 73 and biased downwardly so that its outer tip is normally retained in a recess 74 (shown in FIG. 6) in the mounting plate 54. The central portion of the spring tag 72 is always engaged in a slot 76 formed in an extension portion 77 of the associated projection 66. To remove the winch from the mounting plate 54, the tab 72 is lifted by finger pressure to enter one of the cavities 71 but the central portion of the tag remains in the slot 76 so that upon rotation of the handle in a clockwise direction, the projection 66 disengage from the undercut retaining lugs 67.

FIG. 6 shows that the extension portion 77 has a radially outwardly directed extension 78 having end shoulders 79 and 80. In the engaged position shown in FIG. 6 the shoulder 80 comes into abutment with the end of the lug 67 to limit anti-clockwise rotation of the mounting plate 5. In the disengagement operation, disengagement is complete when the shoulder 80 comes into abutment with the end wall 81 of the other lug 67. It will be noted that the total length of the longest projection 66 including the extension 77 is about 75° whereas the other projections extend through about 57°. This configuration provides a very high degree of engagement between the mounting plate and the flanged base yet assembly is only possible in one rotary position.

FIG. 6 shows in plan view the arrangement with the drum removed. For the purpose of aiding installation of the winch, a lug 75 is provided so that when the winch is used for a yacht headsail, the line from the centre of the shaft 4 through the projection 68 should run directly towards the centre of the boat and at right angles to the longitudinal axis of the boat. As a further aid to identification, the letter S is inscribed to indicate the direction of the lead of the sheet to the drum when the drum winch is used on the starboard side of a yacht and the letter P is used to indicate the lead when the winch is applied to the port side of the yacht.

The lug 75 also acts to limit movement of the bottom handle in normal operation in a clockwise direction and the projection 68 limits anti-clockwise movement. When the handle 40 is against the projection 68, this provides further back up in the event of creepage at the back-stop clutch 7, the drive clutch 6 then absorbing load when the handle is against the projection 68 thereby arresting the drive plate 2.

I claim:

1. A winch for a yacht comprising:

(a) a supporting shaft structure, (b) roller clutch means mounted on the shaft structure, (c) a drum mounted over the roller clutch means and rotatable thereon in a first direction about the shaft structure but restrained by the clutch means against rotation in the opposite rotary direction, (d) seal means for sealing the roller clutch means from the exterior of the winch, and (e) the roller clutch means being dimensioned to have a yieldable interference fit between an exterior case member of the roller clutch means and a central bore in said drum, with lubricant disposed between said exterior case member and said central bore, whereby if the load applied to the drum in said opposite rotary direction exceeds a predetermined value, creepage at the interference fit will occur, said predetermined value being less than that which would damage the roller clutch means.

2. A winch for a yacht comprising:

(a) a supporting shaft structure, (b) roller clutch means mounted on the shaft structure, (c) a drum mounted over the roller clutch means and rotatable thereon in a first direction about the shaft structure but restrained by the clutch means against rotation in the opposite rotary direction, said roller clutch means comprising an inner hardened steel sleeve, rollers retained by a cage and adapted to run over the exterior of said steel sleeve and an outer case member arranged to engage in wedging engagement with the rollers in a locking direction, (d) seal means for sealing the roller clutch means from the exterior of the winch, and (e) the roller clutch means being dimensioned to have a yieldable interference fit between said steel sleeve and said shaft structure, with lubricant between said steel sleeve and said shaft structure, whereby if the load applied to the drum in said opposite rotary direction exceeds a predetermined value, creepage at the interference fit will occur, said predetermined value being less than that which would damage the roller clutch means.

3. A winch according to claim 2 wherein a yieldable interference fit is also established between said case member and a central bore in said drum.

4. A winch for a yacht comprising:

(a) a supporting shaft structure, (b) roller clutch means mounted on the shaft structure, (c) a drum mounted over the roller clutch means and rotatable thereon in a first direction about the shaft structure but restrained by the clutch means against rotation in the opposite rotary direction, (d) seal means for sealing the roller clutch means from the exterior of the winch, said seal means including a resilient O-ring seal for establishing a seal between two components of the winch, one of said components being a base element associated with said supporting shaft structure and having an annular ramp-like surface inclined in a direction having a radially inwardly directed component whereby the O-ring under its inherent resilience tends to move up the ramp-like surface so as to tend to contract, and the other component being the drum having a lower surface adjacent the base element and extending radially inwardly to converge towards the ramp-like surface for receiving in sealing relationship the O-ring seal, (e) the roller clutch means being dimensioned to have a yieldable interference fit between an exterior case member of the roller clutch means and a central bore in said drum, with lubricant disposed between said exterior case member and said central bore, whereby if the load applied to the drum in said opposite rotary direction exceeds a predetermined value, creepage at the interference fit will occur, said predetermined value, being less than that which would damage the roller clutch means.

5. A winch according to claim 1 and further comprising drive means adapted to be engaged by a handle to which torque may be applied, the drive means being rotatably mounted for motion about the axis of the supporting shaft structure, and further roller clutch means having an outer case member and inner sleeve member freely rotatably mounted relative to the shaft structure and fixed to the drive means, said outer case member being arranged in an interference fit within said central bore in said drum, the further roller clutch means permitting torque to be transmitted from the handle to the drum to rotate the drum in said first direction.

6. A winch according to claim 5 and further comprising roller bearing means located between said first and further roller clutch means for rotatably mounting said drum on said supporting shaft structure.

7. A winch according to claim 6 wherein said drive means comprises an annular drive member mounted betwen a flanged base portion of the supporting shaft structure and a base portion of the drum, the annular drive member having a radially outwardly directed aperture for receiving a torque transmitting handle.

8. A winch as claimed in claim 7 wherein said drive means further comprises a top drive element located at a top free end of the winch and having a central socket for receiving a drive plug of a cranked torque transmitting handle, a third roller clutch means being connected between the top drive member and the drum to transmit torque to the drum in said first rotary direction.

9. A winch according to claim 7 and further comprising a mounting plate and a flanged base portion on the supporting shaft structure, the mounting plate and flanged base portion having corresponding interengagement elements for a bayonet-like interconnection and the mounting plate having an upstanding projection extending into an annular cavity in the base of the annular drive member, said annular cavity intersecting with said radially outwardly directed aperture whereby when the drive member is rotated with the handle in position the handle comes against the upstanding projection to rotate the supporting shaft structure to disengage the bayonet-like interconnection.

10. A winch as claimed in claim 6 wherein said drive means comprises a top drive member located at a top free end of the winch and having a central socket for receiving a drive plug of a cranked torque transmitting handle.

11. A winch as claimed in claim 10 and further comprising a mounting plate and a flanged base portion on the supporting shaft structure, the mounting plate and base portion having corresponding interengagement elements for being fitted together in a bayonet-like interengagement by displacement of the winch in said opposite rotary direction and a manually displaceable spring tag secured to the flanged base portion and which is upwardly displaceable to engage into a recess on a base of the drum thereby holding the drum against rotation relative to the supporting shaft structure whereby on rotation of a handle engaged with the top drive member, the drum and supporting shaft structure may be rotated in said first rotary direction to disengage the flanged base portion from the mounting plate.

12. A winch according to claim 1 or 2 wherein the drum has an upper end portion with a radially outwardly extending lip, an intermediate reduced diameter portion which tapers in diameter progressively towards the lower end portion of the drum and the lower end portion of the drum has a concave profile with the bottom shoulder projecting radially outwardly.

13. A winch according to claim 12 wherein said intermediate portion has a straight taper at an angle of about 5° to the axis of the drum and the concave end portion has a radius of curvature equal to approximately half of the radius of the drum in the intermediate portion.

14. A winch according to claim 1 or 2 wherein said supporting shaft structure has a flanged base portion and the winch further comprises a mounting plate adapted to be secured to a yacht, the mounting plate having a plurality of circumferentially extending spaced undercut retaining lugs corresponding peripherally extending projections such that the flanged base portion is mounted by placing the lugs and projections out of alignment and rotating the supporting structure to engage the projections under the lugs, the arrangement of lugs and projections being asymmetric such that the engagement can occur at one rotary position only.

15. A winch for a yacht comprising:

(a) a supporting shaft structure, (b) roller clutch means mounted on the shaft structure, (c) a drum mounted over the roller clutch means and rotatable thereon in a first direction about the shaft structure but restrained by the clutch means against rotation in the opposite rotary direction, said roller clutch means comprising an inner hardened steel sleeve, rollers retained by a cage and adapted to run over the exterior of said steel sleeve and an outer case member arranged to engage in wedging engagement with the rollers in a locking direction, (d) seal means for sealing the roller clutch means from the exterior of the winch, said seal means including a resilient O-ring seal for establishing a seal between two components of the winch, one of said components being a base element associated with said supporting shaft structure and having an annular ramp-like surface inclined in a direction having a radially inwardly directed component whereby the O-ring under its inherent resilience tends to move up the ramp-like surface so as to tend to contract, and the other component being the drum having a lower surface adjacent the base element and extending radially inwardly to converge towards the ramp-like surface for receiving in sealing relationship the O-ring seal, (e) the roller clutch means being dimensioned to have a yieldable interference fit between said steel sleeve and said shaft structure, with lubricant between said steel sleeve and said shaft structure, whereby if the load applied to the drum in said oppposite rotary direction exceeds a predetermined value, creepage at the interference fit will occur, said predetermined value being less than that which would damage the roller clutch means.

* * * * *